US012121787B2

(12) United States Patent
Cokeing et al.

(10) Patent No.: US 12,121,787 B2
(45) Date of Patent: Oct. 22, 2024

(54) GOLF CLUB SHAFTS WITH INSERTS TO REDUCE SHAFT TO SHAFT VARIATION

(71) Applicant: TRUE TEMPER SPORTS, INC., Memphis, TN (US)

(72) Inventors: Scott Cokeing, Memphis, TN (US); Michael Parker Gardner, Memphis, TN (US)

(73) Assignee: TRUE TEMPER SPORTS, INC., Memphis, TN (US)

( * ) Notice: Subject to any disclaimer, the term of this patent is extended or adjusted under 35 U.S.C. 154(b) by 530 days.

(21) Appl. No.: 17/435,474

(22) PCT Filed: Feb. 27, 2020

(86) PCT No.: PCT/US2020/020088
§ 371 (c)(1),
(2) Date: Sep. 1, 2021

(87) PCT Pub. No.: WO2020/180600
PCT Pub. Date: Sep. 10, 2020

(65) Prior Publication Data

US 2022/0134198 A1 May 5, 2022

Related U.S. Application Data

(60) Provisional application No. 62/814,011, filed on Mar. 5, 2019.

(51) Int. Cl.
*A63B 60/42* (2015.01)
*A63B 53/00* (2015.01)
(Continued)

(52) U.S. Cl.
CPC ..... *A63B 60/42* (2015.10); *A63B 53/005* (2020.08); *A63B 53/10* (2013.01); *A63B 60/02* (2015.10); *A63B 2209/00* (2013.01)

(58) Field of Classification Search
CPC ..... A63B 60/02; A63B 60/42
See application file for complete search history.

(56) References Cited

U.S. PATENT DOCUMENTS 6,361,451 B1 * 3/2002 Masters ..... A63B 60/42 482/18
8,702,530 B2 * 4/2014 Slaughter ..... A63B 53/047 473/297
(Continued)

FOREIGN PATENT DOCUMENTS

JP S59064168 U 4/1984
JP S63102779 A 5/1988
(Continued)

OTHER PUBLICATIONS

International Search Report and Written Opinion of the ISA issued in PCT/US2020/020088, mailed Jun. 26, 2020; ISA/KR.
(Continued)

*Primary Examiner* — Joshua T Kennedy

(57) ABSTRACT

A method includes: determining a mass of a golf shaft having a length; determining a center of mass of the golf shaft; determining one or more characteristics of an insert based on: the mass of the golf shaft; and a target mass for golf shafts having the length; determining a location of the insert between a first end of the golf shaft where a golf grip is to be attached and a second end of the golf shaft where a golf club head is to be attached based on: the center of mass of the golf shaft; and a target center of mass for golf shafts having the length; and inserting an insert having the determined one or more characteristics within an interior of the golf shaft at the determined location, thereby creating an interference fit between the insert and the interior of the golf shaft.

17 Claims, 5 Drawing Sheets

(51) Int. Cl.
*A63B 53/10* (2015.01)
*A63B 60/02* (2015.01)

(56) References Cited

U.S. PATENT DOCUMENTS

| | | | | |
|---|---|---|---|---|
| 9,295,888 | B2 * | 3/2016 | Fujiwara | A63B 53/12 |
| 9,463,363 | B2 | 10/2016 | Dingman et al. | |
| 9,616,298 | B1 * | 4/2017 | Barksdale | A63B 53/10 |
| 9,827,472 | B2 * | 11/2017 | Kammerer | A63B 53/14 |
| 11,278,780 | B2 * | 3/2022 | Milleman | A63B 53/10 |
| 11,426,642 | B1 * | 8/2022 | Hamburger | A63B 60/22 |
| 11,691,059 | B2 * | 7/2023 | Milleman | A63B 53/10 473/296 |
| 2004/0087384 | A1 * | 5/2004 | Sosin | A63B 60/46 473/289 |
| 2008/0274822 | A1 * | 11/2008 | Lindner | A63B 60/24 473/297 |
| 2010/0292022 | A1 * | 11/2010 | Stites | A63B 53/10 473/282 |
| 2011/0077095 | A1 * | 3/2011 | Olsson | A63B 53/00 473/287 |
| 2013/0017902 | A1 * | 1/2013 | Cheng | A63B 53/10 473/319 |
| 2013/0165249 | A1 * | 6/2013 | Margoles | A63B 60/22 473/297 |
| 2014/0342845 | A1 | 11/2014 | Dingman | |
| 2015/0251063 | A1 * | 9/2015 | Dingman | A63B 53/14 473/297 |
| 2015/0258398 | A1 * | 9/2015 | Knutson | A63B 21/08 473/292 |
| 2017/0021250 | A1 * | 1/2017 | Milleman | A63B 53/007 |
| 2022/0314083 | A1 * | 10/2022 | Adams | A63B 60/02 |

FOREIGN PATENT DOCUMENTS

| | | | |
|---|---|---|---|
| JP | H09085842 | A | 3/1997 |
| JP | 2012110498 | A | 6/2012 |
| KR | 2020100009595 | U | 9/2010 |
| KR | 101734870 | B1 | 5/2017 |
| WO | WO-2016191589 | A2 | 12/2016 |

OTHER PUBLICATIONS

Japanese Notice of Reasons for Refusal for corresponding Japanese Application No. 2021- 552711 dated Sep. 22, 2023.

* cited by examiner

GOLF CLUB SHAFTS WITH INSERTS TO REDUCE SHAFT TO SHAFT VARIATION

CROSS-REFERENCE TO RELATED APPLICATIONS

This application is a U.S. National Phase Application under 35 U.S.C. 371 of International Application No. PCT/US2020/020088, filed on Feb. 27, 2020, which claims the benefit of U.S. Provisional Application No. 62/814,011, filed on Mar. 5, 2019. The entire disclosures of the applications referenced above are incorporated herein by reference.

FIELD

The present disclosure relates to shafts of golf clubs and more particularly to golf club shafts with inserts and methods of manufacturing golf club shafts.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Golf shafts are manufactured in various lengths for various different types of golf clubs. Some golf shafts are steel golf shafts, and some golf shafts are graphite golf shafts.

SUMMARY

In a feature, a method includes: determining a mass of a golf shaft having a length; determining a center of mass of the golf shaft; determining one or more characteristics of an insert to insert into the golf shaft based on: the mass of the golf shaft; and a target mass for golf shafts having the length; determining a location of the insert between a first end of the golf shaft where a golf grip is to be attached and a second end of the golf shaft where a golf club head is to be attached based on: the center of mass of the golf shaft; and a target center of mass for golf shafts having the length; and inserting an insert having the determined one or more characteristics within an interior of the golf shaft at the determined location, thereby creating an interference fit between the insert and the interior of the golf shaft.

In further features, the insert is a hollow tube having the determined one or more characteristics.

In further features, the hollow tube has a uniform mass per unit length, and the one or more characteristics include a length of the hollow tube.

In further features, determining the one or more characteristics includes determining the length of the hollow tube based on (a) the target mass for golf shafts having the length minus (b) the mass of the of the golf shaft.

In further features: determining a target mass for the insert based on (a) the target mass for golf shafts having the length minus (b) the mass of the of the golf shaft; and based on the target mass for the insert, cutting the length of the hollow tube from a supply of the hollow tube that is longer than the length.

In further features: determining a target mass for the insert based on (a) the target mass for golf shafts having the length minus (b) the mass of the of the golf shaft; and selecting one of a plurality of pre-cut inserts of different lengths based on the target mass for the insert.

In further features, the hollow tube includes a polymer.

In further features, the hollow tube includes at least one of polycarbonate, plastic, and polytetrafluoroethylene (PTFE).

In further features, the hollow tube has an outer diameter of approximately 7/16" to approximately ½".

In further features, the hollow tube has an outer diameter that is greater than an inner diameter of the golf shaft at a location approximately ⅔ of the length from the first end of the golf shaft toward the second end of the golf shaft.

In further features, inserting the insert includes inserting the insert using a linear inserting rod.

In further features, inserting the insert includes inserting the insert using a linear inserting rod by applying at least approximately 200 pounds of force to the insert while the golf shaft is held stationary.

In further features, determining the mass of the golf shaft includes measuring the mass of the golf shaft using a scale.

In further features, determining the center of mass of the golf shaft includes determining the center of mass of the golf shaft based on the length of the golf shaft and the mass of the golf shaft.

In further features, determining the center of mass includes determining the center of mass, by a center of mass module, using one of a lookup table and an equation that relates lengths of golf shafts and masses of golf shafts to centers of mass.

In further features, the method further includes adhering the insert to the interior of the golf shaft at the determined location.

In further features, adhering includes heating the golf shaft and insert using a furnace at a predetermined temperature for a predetermined period.

In a feature, a golf shaft includes: a tubular member that includes an outer surface, that includes a hollow interior, and that decreases in diameter from a first end for attachment of a grip to a second end for attachment of a golf club head; and an insert that is interference fit within the hollow interior of the tubular member at a location lengthwise between the first end and the second end, the location being chosen based on a target center of mass for the golf shaft, and a mass of the insert being chosen based on a target mass for the golf shaft minus a mass of the golf shaft without the insert.

In a feature, a golf club includes: the golf shaft; the golf grip attached at the first end; and the golf club head attached at the second end.

In a feature, a set of golf clubs includes: the golf club and a plurality of additional golf clubs.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

Golf shafts are manufactured in various lengths for different types of golf clubs. A finished golf shaft has target performance specifications including a target weight and a target center of mass. The target center of mass is a target location between a butt end of the golf shaft (where a grip will be attached) and a tip end of the golf shaft (where a golf club head will be attached) for the center of mass of the golf shaft. A finished golf club is assembled from multiple components, including a golf club head, a golf club shaft, and a grip. Each component has weight and center of mass tolerances which can change the finished golf clubs weight and/or center of mass to be different than targeted.

If manufacturing variation of weight and center of mass of all components is eliminated, the finished golf clubs will have the same consistent performance from club to club with minimal or no variation. Club to club variation can lead to inconsistent golf shot performance.

The present application involves golf club shafts with weight inserts sized and positioned such that each of the golf club shafts (of the same length) has approximately the same target weight and target center of mass. This decreases club to club variation attributable to the golf club shafts.

Figure 1:
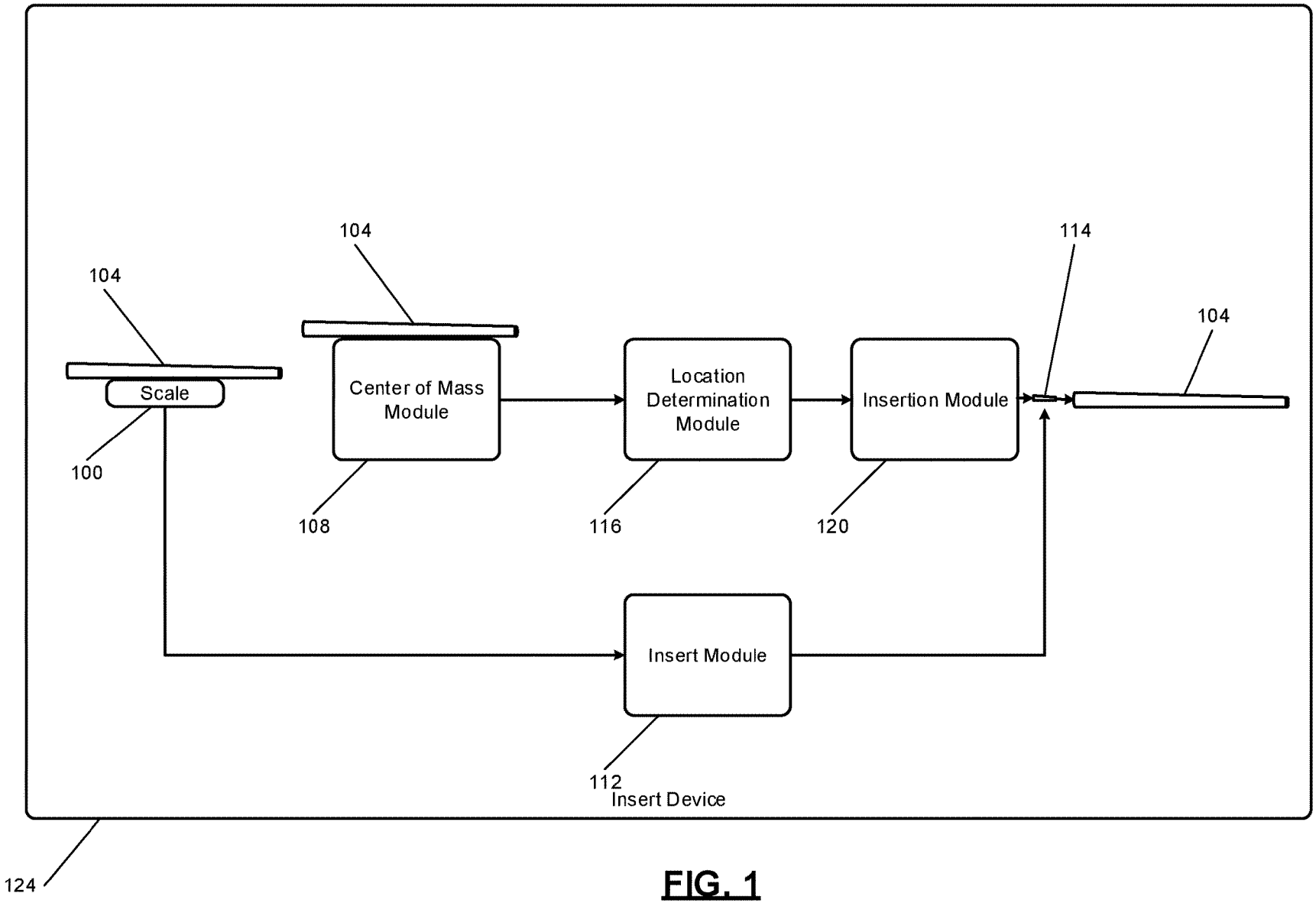
FIG. 1 includes an example illustration of a golf shaft weighting system.

FIG. 1 includes an example illustration of a golf shaft weighting system. A scale 100 measures the mass of a golf shaft 104. The golf shaft 104 may be a graphite golf club shaft, a steel golf club shaft, a hybrid steel and graphite golf club shaft, or another type of golf club shaft. The golf shaft 104 may include one or more tapered portions.

Before the addition of an insert, the mass of the golf shaft 104 is less than a target mass for the golf shaft 104 and other golf shafts that are the same length as the golf shaft 104. Each golf shaft of a given length is manufactured to have a mass that is less than the target mass for golf shafts of that length.

A center of mass module 108 measures or determines the center of mass of the golf shaft 104. The center of mass module 108 may determine the center of mass, for example, based on the length and the mass of the golf shaft 104, for example, using one of a lookup table and an equation that relates lengths and masses to centers of mass. The golf shaft and the other golf shafts also have a target center of mass.

An insert module 112 determines a target mass of an insert to be inserted into the interior of the golf shaft 104 based on the mass of the golf shaft 104 and the target mass for the golf shaft 104. For example, the insert module 112 may set the target mass for the insert to the target mass minus the mass of the golf shaft 104.

The insert module 112 also outputs an insert 114 having the target mass. For example, the insert 114 may be a length of a hollow polymer tube having a uniform mass per unit length. Examples of the polymer include polycarbonate, plastic, polytetrafluoroethylene (PTFE), etc. The polymer tube may have a uniform diameter and a circular cross-section. The insert module 112 may include a roll of the hollow polymer tube and a cutting apparatus and may cut the hollow polymer tube to a length corresponding to the target weight to create the insert 114. Alternatively, a plurality of different lengths of the hollow polymer tube may be pre-cut, and the insert module 112 may select one of the lengths that has a mass that is closest to the target mass for the insert 114. The hollow polymer tube may have, for example, a 7/16" (1.11125 centimeter) outer diameter, a ½" (1.27 centimeter) outer diameter, an outer diameter between approximately 7/16" and approximately ½", or another suitable outer diameter. The outer diameter of the hollow polymer tube may be greater than an inner diameter at a location ⅔ of the way from the butt end to the tip end of the golf shafts of that length. The outer diameter being greater than the inner diameter may cause the hollow polymer tube to deform during insertion into golf shafts yet not plug the golf shafts. Plugging of a golf shaft (as may occur if solid/non-hollow inserts were used) may make securing a golf club head and/or a grip to the golf shaft difficult and non-optimal.

A location determination module 116 determines a target location of the insert within the golf shaft 104 based on the mass of the insert and the center of mass of the golf shaft 104. The location determination module 116 determines the target location of the insert within the golf shaft using one of an equation and a lookup table that relates masses of inserts and centers of mass to target locations. The location determination module 116 determines the target location to adjust the center of mass of the golf shaft 104 toward or to the target center of mass. The target location refers to a location along the length (axially) of the golf shaft 104.

An insertion module 120 receives the insert 114 for the golf shaft 104 and inserts the insert 114 into the interior of the golf shaft 104 at the target location determined for the insert. The insertion of the insert 114 creates an interference fit between the insert 114 and the golf shaft 104. With the insert 114 of the target mass located at the target location within the golf shaft 104, the golf shaft 104 has approximately the target mass for the golf shaft 104 (and other golf shafts of that length) and the target center of mass for the golf shaft 104 (and other golf shafts of that length). Inserts are added to each golf shaft such that each golf shaft has approximately a target mass and a target center of mass for its length.

In various implementations, an insert device 124 may be an automated device that includes the scale 100, the center of mass module 108, the location determination module 116, the insert module 112, and the insertion module 120. In various implementations, the functionality of one or more of the modules may be performed via a user.

Once the insert 114 has been inserted into the golf shaft 104, the golf shaft 104 is subjected to one or more heat treatments for one or more predetermined periods, respectively. For example, the golf shaft 104 may be heated (e.g., by a furnace) to a predetermined temperature that is less than or equal to the melting point temperature of the insert 114 for a predetermined period. In various implementations, the predetermined temperature may be greater than the melting point temperature of the insert. In such an implementation, the predetermined period may be set low enough to allow for melting of an exterior portion skin of the insert 114 while preventing melting of the remainder of the insert 114. The heating of the golf shaft 104 and the insert 114 adheres the insert 114 to the interior surface of the golf shaft 104 and increases a force necessary to remove the insert 114 from the golf shaft 104.

Figure 2:
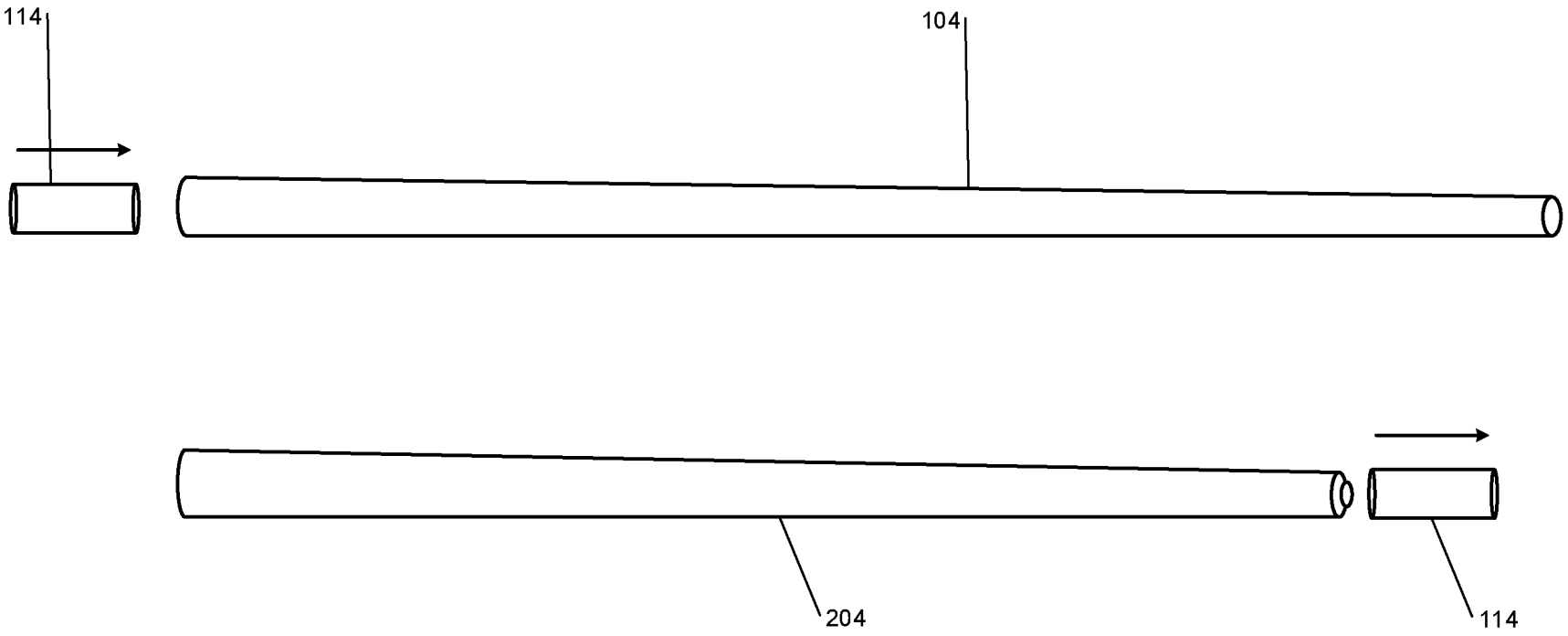
FIG. 2 includes an example illustration of a golf club shaft and an insert prior to insertion of the insert into the golf shaft.

FIG. 2 includes an example illustration of the golf club shaft and the insert 114 prior to insertion of the insert 114 into the golf shaft 104. The insertion module 120 may insert the insert 114 into the golf shaft 104 via an inserting rod 204. The inserting rod 204 be moved linearly approximately coaxially with the golf shaft 104 into the hollow interior of the golf shaft 104 to push the insert 114 to the target location within the interior of the golf shaft 104. For example only, the inserting rod 204 may apply at least approximately 200 pounds of force (approximately 889 Newtons) to the insert 114 while the golf shaft 104 is held stationary to insert the insert 114. The force applied to the insert 114, however, may be greater than or less than 200 pounds. The insertion module 120 may include a linear actuator that linearly actuates the inserting rod 204 into the golf shaft 104.

Figure 3:
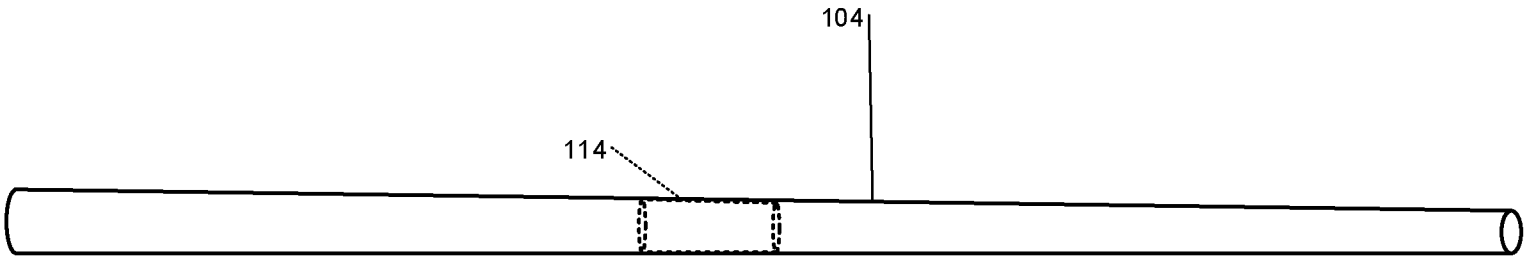
FIG. 3 is an example illustration of the insert fixed within the interior of the golf shaft.

FIG. 3 is an example illustration of the insert 114 fixed within the interior of the golf shaft 104.

Figure 4:
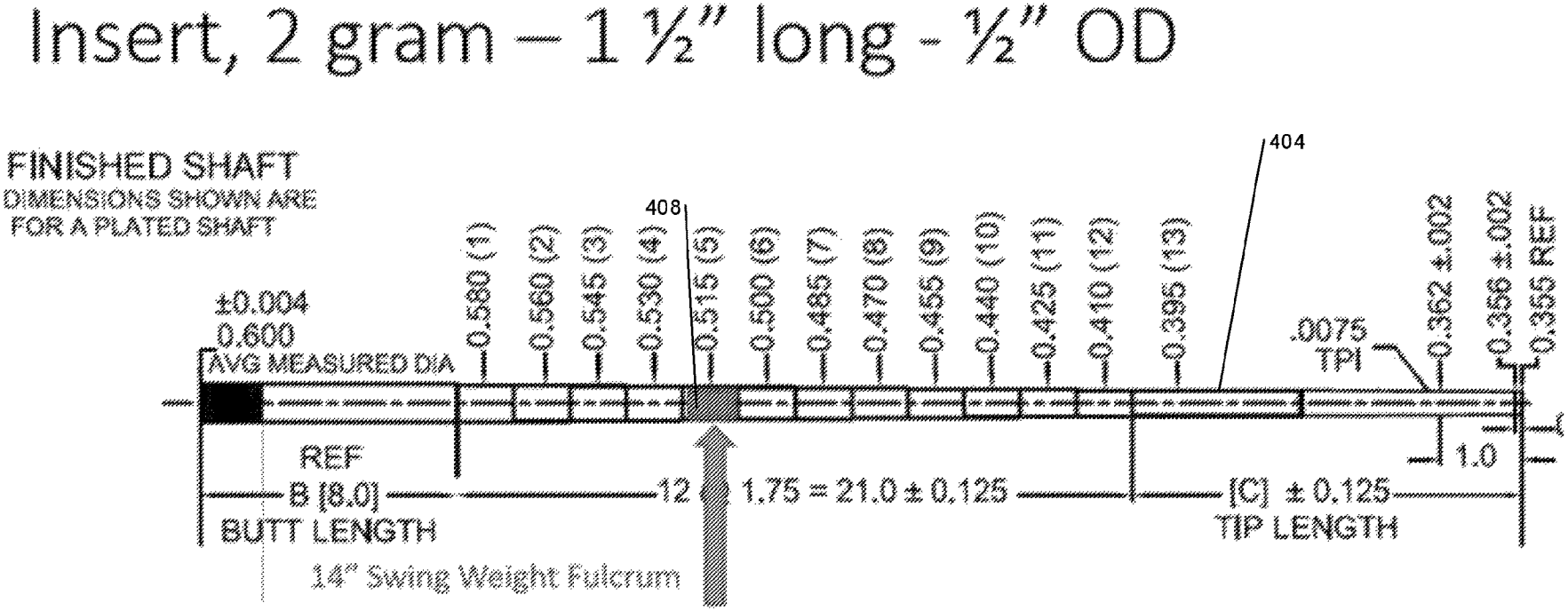
FIG. 4 includes an example illustration of a golf shaft and an insert within the golf shaft.

FIG. 4 includes an example illustration of a golf shaft 404 and an insert 408 within the golf shaft 404. In the example of FIG. 4, the mass of the golf shaft 404 was 2 grams less the target mass of the golf shaft 404. Thus, the insert 408 has a mass of 2 grams. The mass of the golf shaft 404 after the insertion of the insert 408 is approximately equal to the target mass of the golf shaft 404.

The insert 408 was inserted to a location within the golf shaft 404 such that the center of mass of the golf shaft 404 (including the insert 408) is approximately at the target center of mass of the golf shaft 404. For example, if the center of mass of the golf shaft 404 (without the insert 408) was more toward the butt end of the golf shaft 404 than the target center of mass of the golf shaft 404, the insert 408 will be located more toward the tip end of the golf shaft 404 than the target center of mass of the golf shaft 404. This adjusts the center of mass of the golf shaft 404 (with the insert 408) toward or to the target center of mass. If the center of mass of the golf shaft 404 (without the insert 408) was more toward the tip end of the golf shaft 404 than the target center of mass of the golf shaft 404, the insert 408 will be located more toward the butt end of the golf shaft 404 than the target center of mass of the golf shaft 404. This adjusts the center of mass of the golf shaft 404 (with the insert 408) toward or to the target center of mass.

Figure 5:
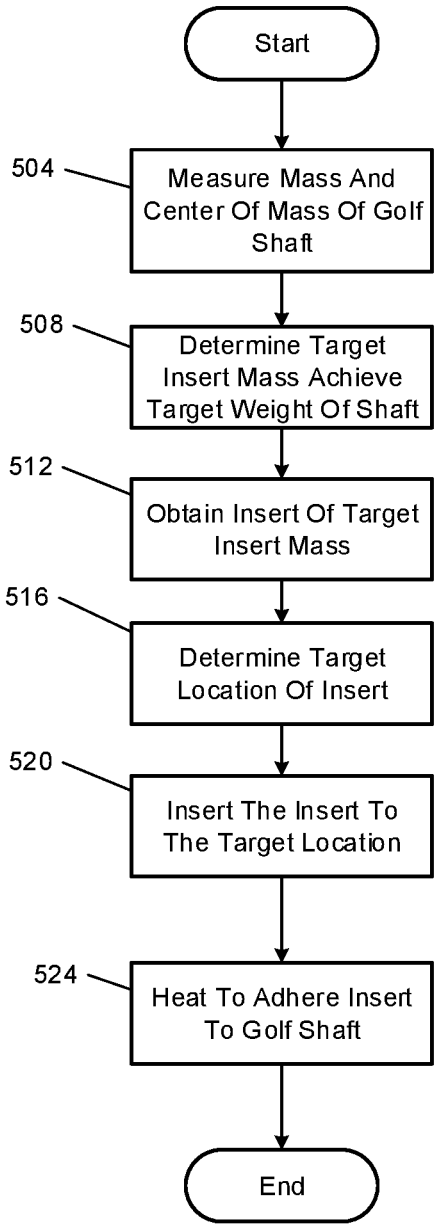
FIG. 5 includes an example method of weighting a golf shaft to achieve a target mass of the golf shaft and a target center of mass of the golf shaft.

FIG. 5 includes an example method of weighting a golf shaft to achieve a target mass of the golf shaft and a target center of mass of the golf shaft. The method begins with 504 where the scale 100 measures the mass of the golf shaft and the center of mass module 108 determines the center of mass of the golf shaft. The golf shaft has a target mass and a target center of mass.

At 508, the insert module 112 determines the target mass of an insert to adjust the mass of the golf shaft to the target mass of the golf shaft. For example, the insert module 112 may set the target mass of the insert equal to the target mass of the golf shaft minus the mass of the golf shaft. At 512, the insert module 112 also outputs an insert having the target mass of the insert. For example, the insert module 112 may cut a length of insert material to have the target mass or select one of a plurality of different masses of inserts that has a mass that is closest to the target mass of the insert.

At 516, the location determination module 116 determines the target location of the insert based on the center of mass of the golf shaft and the target center of mass of the golf shaft. For example, if the center of mass of the golf shaft is closer to the tip end of the golf shaft than the target center of mass of the golf shaft, the location determination module 116 may set the target location of the insert closer to the butt end of the golf shaft. If the center of mass of the golf shaft is closer to the butt end of the golf shaft than the target center of mass of the golf shaft, the location determination module 116 may set the target location of the insert closer to the tip end of the golf shaft. If the center of mass of the golf shaft is at the target center of mass of the golf shaft, the location determination module 116 may set the target location of the insert to the target center of mass of the golf shaft.

At 520, the insertion module 120 inserts the insert (having the target mass of the insert) to the target location of the insert within the golf shaft and creates an interference fit between the insert and the interior surface of the golf shaft. The golf shaft then (with the insert) has approximately the target center of mass of the golf shaft and has approximately the target mass of the golf shaft. At 524, the golf shaft (including the insert) is heated (e.g., via a furnace) to adhere the insert to the interior surface of the golf shaft. In various implementations, an adhesive may be used on outer surfaces of the insert to adhere the insert to the interior surface of the golf shaft. In such implementations, the target mass of the insert may be reduced based on a predicted mass of the adhesive.

While the example of inserting an insert into a golf shaft is provided above, the above is also applicable to inserting an insert into a tubular member of a shaft of another type of sports equipment. For example, the above is applicable to inserting inserts into a tubular member of a hockey stick, a lacrosse stick, etc. Also, while the example of a round tubular member (of a golf shaft) is provided, the above is also applicable to tubular members of other shapes, such as rectangular (including square), pentagonal, hexagonal, heptagonal, octagonal, etc.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure. As used herein, approximately may mean +/−10 percent of the stated value.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

In the figures, the direction of an arrow, as indicated by the arrowhead, generally demonstrates the flow of information (such as data or instructions) that is of interest to the illustration. For example, when element A and element B exchange a variety of information but information transmitted from element A to element B is relevant to the illustration, the arrow may point from element A to element B. This unidirectional arrow does not imply that no other information is transmitted from element B to element A. Further, for information sent from element A to element B, element B may send requests for, or receipt acknowledgements of, the information to element A.

In this application, including the definitions below, the term "module" or the term "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language), XML (extensible markup language), or JSON (JavaScript Object Notation) (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective-C, Swift, Haskell, Go, SQL, R, Lisp, Java®, Fortran, Perl, Pascal, Curl, OCaml, Javascript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, and Python®.

What is claimed is:

1. A method comprising:

determining a mass of a golf shaft having a length;

determining a center of mass of the golf shaft;

determining one or more characteristics of an insert to insert into the golf shaft based on:

the mass of the golf shaft; and a target mass for golf shafts having the length;

determining a location of the insert between a first end of the golf shaft where a golf grip is to be attached and a second end of the golf shaft where a golf club head is to be attached based on:

the center of mass of the golf shaft; and a target center of mass for golf shafts having the length; and inserting an insert having the determined one or more characteristics within an interior of the golf shaft at the determined location, thereby creating an interference fit between the insert and the interior of the golf shaft.

2. The method of claim 1 wherein the insert is a hollow tube having the determined one or more characteristics.

3. The method of claim 2 wherein the hollow tube has a uniform mass per unit length, and the one or more characteristics include a length of the hollow tube.

4. The method of claim 3 wherein determining the one or more characteristics includes determining the length of the hollow tube based on (a) the target mass for golf shafts having the length minus (b) the mass of the of the golf shaft.

5. The method of claim 2 further comprising:

determining a target mass for the insert based on (a) the target mass for golf shafts having the length minus (b) the mass of the of the golf shaft; and based on the target mass for the insert, cutting the length of the hollow tube from a supply of the hollow tube that is longer than the length.

6. The method of claim 2 further comprising:

determining a target mass for the insert based on (a) the target mass for golf shafts having the length minus (b) the mass of the of the golf shaft; and selecting one of a plurality of pre-cut inserts of different lengths based on the target mass for the insert.

7. The method of claim 2 wherein the hollow tube includes a polymer.

8. The method of claim 2 wherein the hollow tube includes at least one of polycarbonate, plastic, and polytetrafluoroethylene (PTFE).

9. The method of claim 2 wherein the hollow tube has an outer diameter of approximately 7/16" to approximately ½".

10. The method of claim 2 wherein the hollow tube has an outer diameter that is greater than an inner diameter of the golf shaft at a location approximately ⅔ of the length from the first end of the golf shaft toward the second end of the golf shaft.

11. The method of claim 1 wherein inserting the insert includes inserting the insert using a linear inserting rod.

12. The method of claim 11 wherein inserting the insert includes inserting the insert using a linear inserting rod by applying at least approximately 200 pounds of force to the insert while the golf shaft is held stationary.

13. The method of claim 1 wherein determining the mass of the golf shaft includes measuring the mass of the golf shaft using a scale.

14. The method of claim 1 wherein determining the center of mass of the golf shaft includes determining the center of mass of the golf shaft based on the length of the golf shaft and the mass of the golf shaft.

15. The method of claim 14 wherein determining the center of mass includes determining the center of mass, by a center of mass module, using one of a lookup table and an equation that relates lengths of golf shafts and masses of golf shafts to centers of mass.

16. The method of claim 14 further comprising adhering the insert to the interior of the golf shaft at the determined location.

17. The method of claim 16 wherein the adhering includes heating the golf shaft and insert using a furnace at a predetermined temperature for a predetermined period.

* * * * *